US009362623B2

(12) United States Patent
Tan et al.

(10) Patent No.: US 9,362,623 B2
(45) Date of Patent: Jun. 7, 2016

(54) GRIDDED ANTENNA AND METHOD FOR MANUFACTURING THE SAME

(71) Applicants: Yew Choon Tan, Singapore (SG); Ng Guan Hong, Singapore (SG); Roger Tay, Singapore (SG)

(72) Inventors: Yew Choon Tan, Singapore (SG); Ng Guan Hong, Singapore (SG); Roger Tay, Singapore (SG)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 314 days.

(21) Appl. No.: 13/921,338

(22) Filed: Jun. 19, 2013

(65) Prior Publication Data

US 2014/0159962 A1 Jun. 12, 2014

(30) Foreign Application Priority Data

Dec. 6, 2012 (CN) ..... 2012 1 0518079

(51) Int. Cl.

| | |
|---|---|
| ***H01Q 1/24*** | (2006.01) |
| ***H01Q 9/04*** | (2006.01) |
| *H01Q 1/22* | (2006.01) |

(52) U.S. Cl.

CPC ..... *H01Q 9/0407* (2013.01); *H01Q 1/2225* (2013.01); *H01Q 9/0421* (2013.01); *Y10T 29/49016* (2015.01)

(58) Field of Classification Search

CPC .. H01Q 9/0407; H01Q 1/2225; H01Q 9/0421
See application file for complete search history.

(56) References Cited

U.S. PATENT DOCUMENTS

| | | | | |
|---|---|---|---|---|
| 6,480,170 | B1 * | 11/2002 | Langley et al. | 343/826 |
| 2004/0257285 | A1 * | 12/2004 | Quintero Illera et al. | 343/702 |
| 2005/0237243 | A1 * | 10/2005 | Annamaa et al. | 343/702 |
| 2006/0164309 | A1 * | 7/2006 | Fujishima et al. | 343/700 MS |
| 2008/0018543 | A1 * | 1/2008 | Baliarda et al. | 343/702 |
| 2009/0146906 | A1 * | 6/2009 | Anguera Pros et al. | 343/906 |
| 2011/0227809 | A1 * | 9/2011 | Lee et al. | 343/909 |

* cited by examiner

*Primary Examiner* — Trinh Dinh
(74) *Attorney, Agent, or Firm* — Anova Law Group, PLLC

(57) ABSTRACT

An antenna is disclosed. The antenna includes a substrate and an antenna layer disposed on a top surface of the substrate. The antenna layer includes a patch and a feed line electrically connected to the patch. The patch includes a number of slots disposed at a center portion thereof for forming a gridding part and an edge part surrounding the gridding part. A ratio of the width of the edge part and the width of the patch is at least 0.32.

12 Claims, 5 Drawing Sheets

GRIDDED ANTENNA AND METHOD FOR MANUFACTURING THE SAME

FIELD OF THE INVENTION

The present disclosure relates to antennas for portable devices, and more specifically to a gridded antenna and a method for manufacturing the same.

DESCRIPTION OF RELATED ART

With the rapidly development of radio frequency identification technologies, radio frequency identification (RFID) tags are widely used in various fields such as distribution, logistic, material handling industries, and non-contact integrated circuits. A related radio frequency identification tag generally includes an antenna.

With the demands for low cost, reliable and flexible antenna for wireless communication, there is a growth in using conductive ink printed antenna. Conductive ink, being able to print on a variety of substrate materials such as polyester provides a promising alternative for printing antenna. However, the conductive ink, such as silver, is relatively expensive.

Therefore, it is desirable to provide a new antenna and a new method which can overcome the above-mentioned problems.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
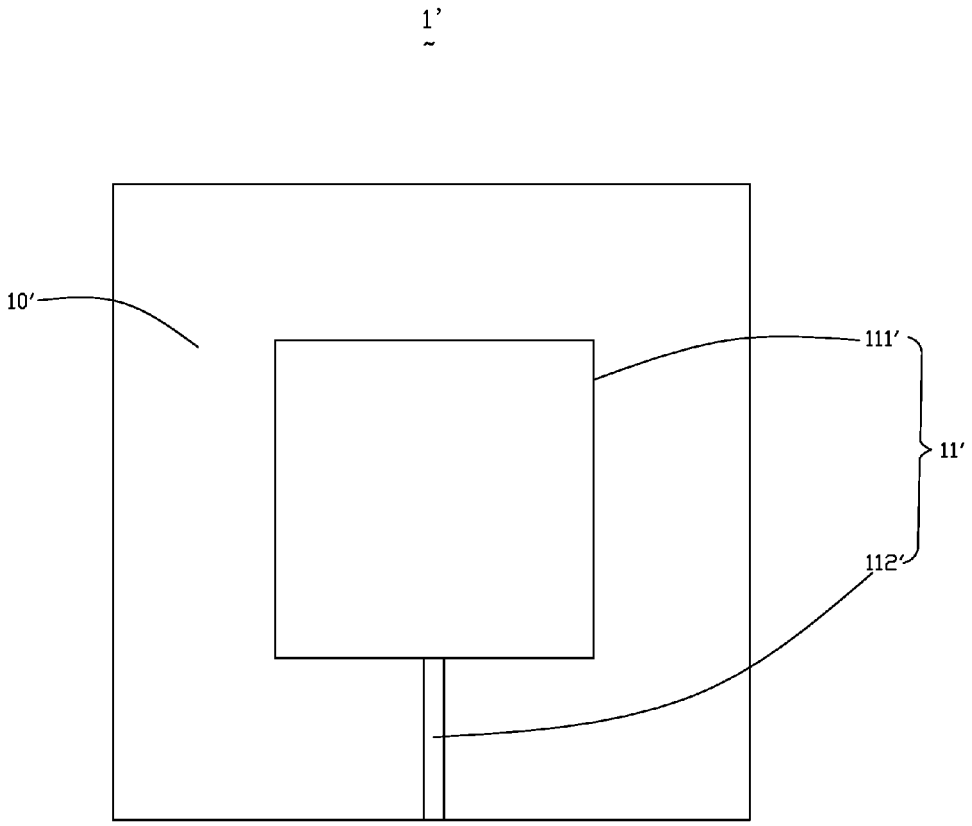
FIG. 1 shows a first conventional antenna related to the present disclosure.

Referring to FIG. 1, a first conventional antenna 1' comprises a substrate 10' and an antenna layer 11' disposed on a top surface of the substrate 10'. The antenna layer 11' is printed on the substrate 10' by using conductive ink and comprises a patch 111' and a feed line 112'. The patch 111' is a whole without gaps.

Figure 2:
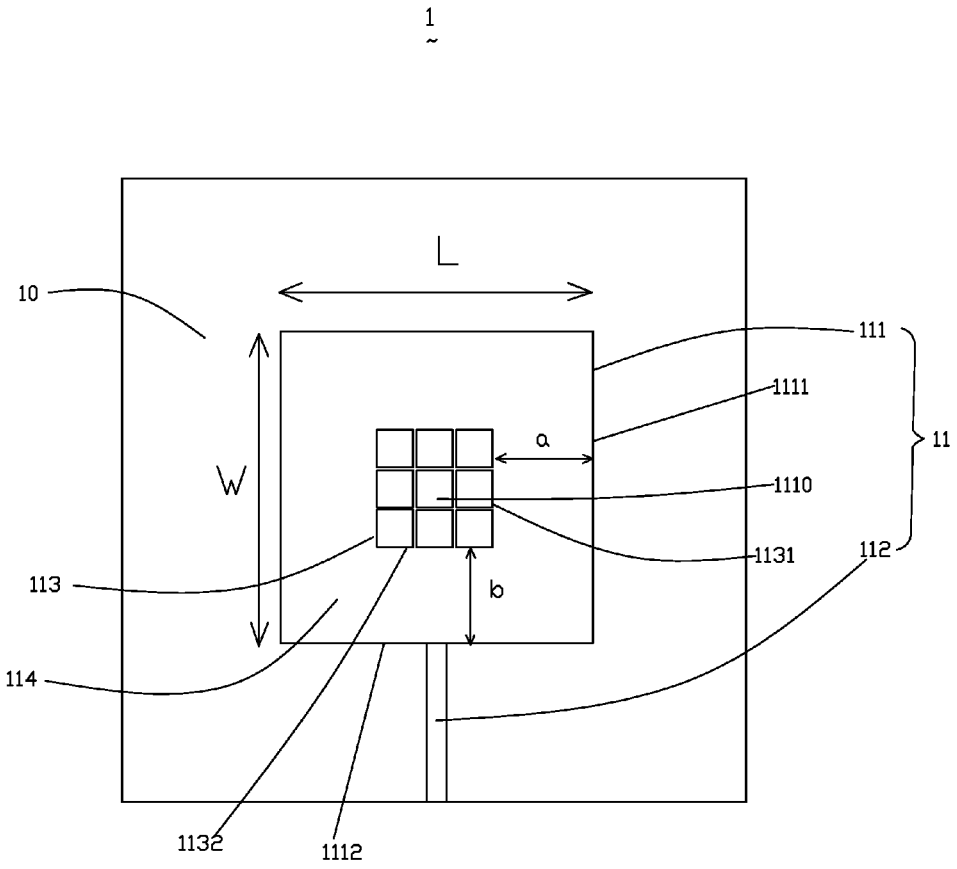
FIG. 2 shows a gridded antenna in accordance with a first embodiment of the present disclosure.

Referring to FIG. 2, a gridded antenna 1 in accordance with a first embodiment of the present disclosure is a revised antenna according to the first conventional antenna 1'. The gridded antenna 1 comprises a substrate 10 and an antenna layer 11 disposed on a top surface of the substrate 10. The antenna layer 11 includes a patch 111 defining a width L, and a feed line 112 extending from the patch 111. The patch 111 includes a number of slots 1110 forming a gridding part 113, and an edge part 114 surrounding the gridding part 113. The feed line 112 is electrically connected to the edge part 114. The gridding part 113 is disposed at a center portion of the patch 111. In this embodiment, the the slots are arranged in a 3 by 3 matrix. The arrangement of the slots, however, is variable according to actual requirements, and the slots may be arranged in matrixes ranging from 3 by 3 to 20 by 20.

The substrate 10 is made from FR-4. The antenna layer 11 is manufactured by printing conductive ink on the substrate 10.

The edge part 114 has a first width a, which is measured from an first side 1131 of the gridding part 113 to a first edge 1111 of the patch 111 opposite to the first side 1131. The edge part 114 has a second width b, which is measured from a second side 1132 of the gridding part 113 to a second edge 1112 of the patch 111 opposite to the second side 1132. A parameter of width_ratio is defined as follows for defining the width of the edge part 114:

$$\text{Width_ratio}=a/L, \text{ or Width_ratio}=b/W$$

Figure 3:
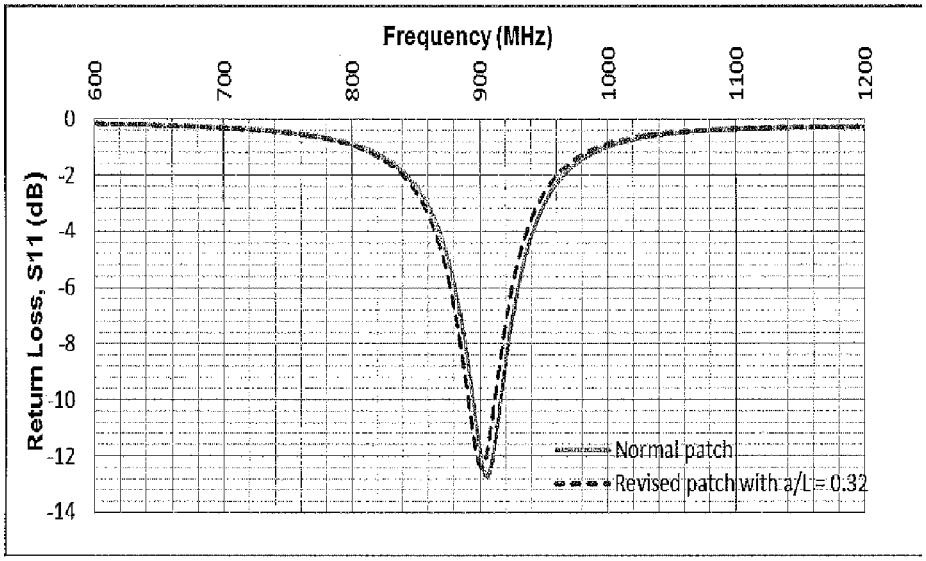
FIG. 3 illustrates a comparison of the return loss between the first conventional antenna and the gridded antenna.
Figure 4:
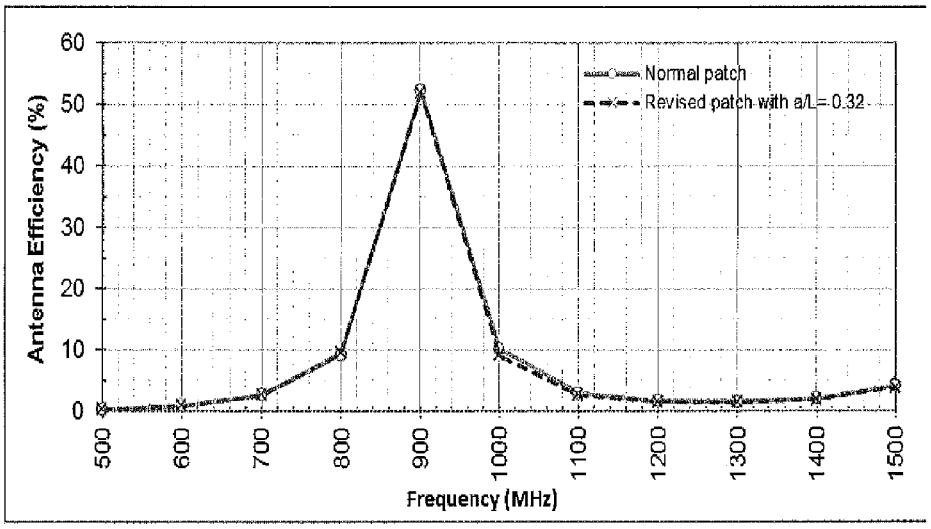
FIG. 4 illustrates a comparison of the antenna efficiency between the first conventional antenna and the gridded antenna.

By simulation, different values of the width_ratio ranging from 0.1 has been studied and it is found that width_ratio has to be at least 0.32 in order to produce almost identical performance characteristics as the first conventional antenna without slots. These can be seen from the simulation results of return Loss and total efficiency shown in FIG. 3 and FIG. 4.

Separate simulations were conducted for the gridded antenna 1 with different number of slots arranged in matrixes from 3 by 3, to 20 by 20. The simulation results suggested that with increasing number of slots in the gridded antenna, its antenna performance characteristics get closer to that of the first conventional antenna. Therefore, the gridded antenna 1 has a reduced conductive area while retaining substantial identical performance characteristics to the conventional antenna. In the embodiment, the patch 111 could be square and rectangular.

A method for manufacturing the gridded antenna comprises steps of: providing a substrate 10;

forming an antenna layer 11 on the substrate 10 by printing conductive ink, the antenna layer 11 including a patch 111 and a feed line 112, the patch 111 including a plurality of slots 1110 forming a gridding part 113 and an edge part 114 surrounding around the gridding part 113, a ratio of a width of the edge part and that of the gridding part being at least 0.32.

Figure 5:
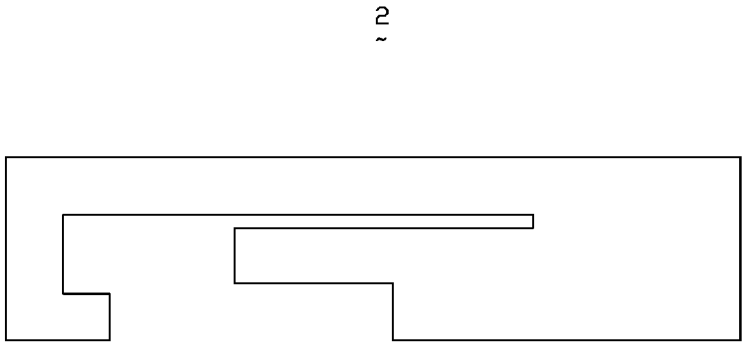
FIG. 5 shows a second conventional antenna related to the present disclosure.

Referring to FIG. 5, an second conventional antenna 2 is a dual-band Planar Inverted-F Antenna (PIFA) working at GSM-850 and PCS-1900 bands, which is made by cutting a thin copper sheet.

Figure 6:
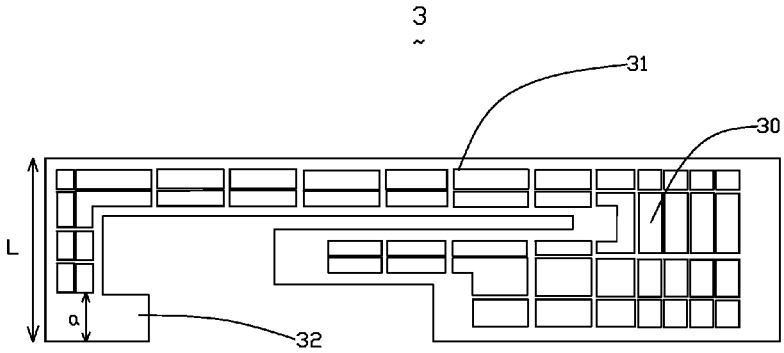
FIG. 6 shows a gridded antenna in accordance with a second embodiment of the present disclosure.

Referring to FIG. 6, a gridded antenna 3 in accordance to a second embodiment of the present disclosure is a revised PIFA antenna according to the second conventional antenna 2. The antenna 3 is a metallic sheet. The antenna 3 includes a plurality of slots 30 forming a gridding part 31 and an edge part 32 surrounding around the gridding part 31. The edge part 32 has a width a, and the antenna 3 has a width L. The width a of the edge part 32 satisfies the requirement for width_ratio=a/L=0.32. The total conductive surface area of the second conventional antenna 2 is 696 $mm^2$ and that of the antenna 3 is 485 $mm^2$, hence 30.3% of the conductive area is reduced.

Figure 7:
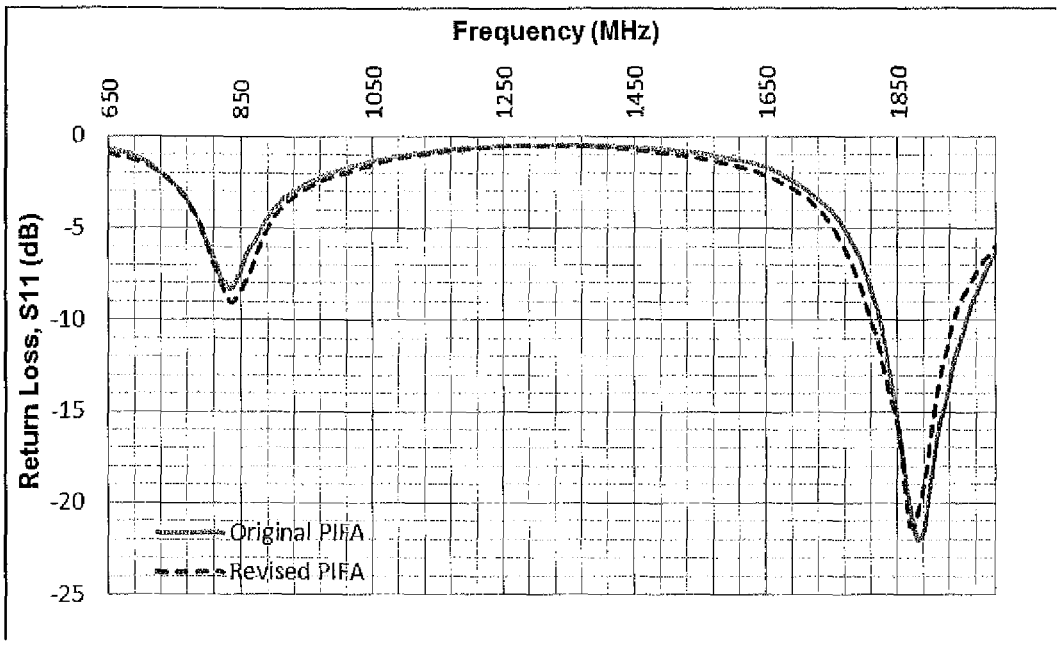
FIG. 7 illustrates a comparison of the return loss between the second conventional antenna and the gridded antenna.
Figure 8:
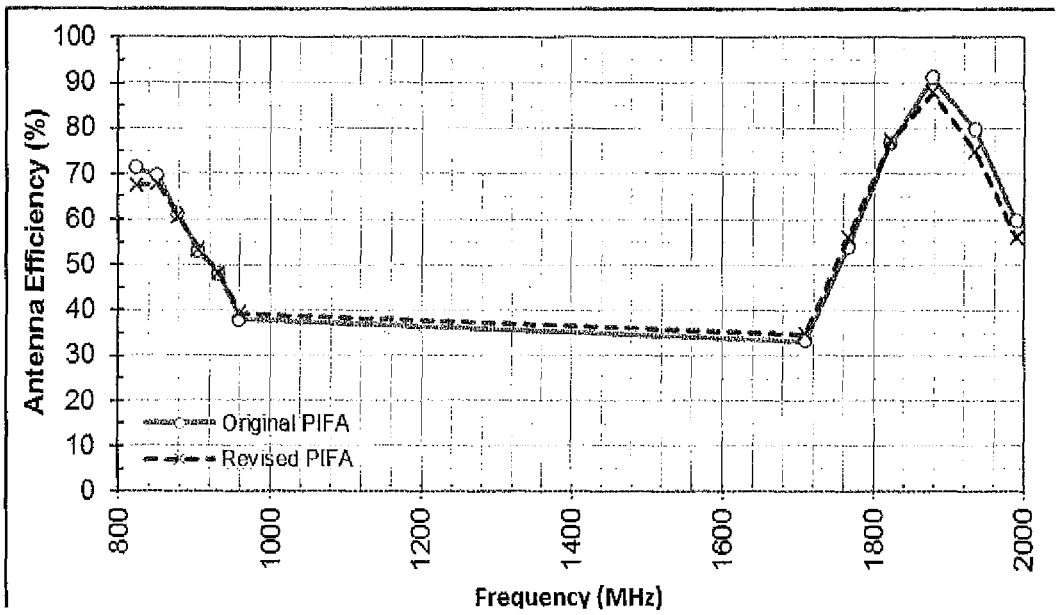
FIG. 8 illustrates a comparison of the antenna efficiency between the second conventional antenna and the gridded antenna.

Referring to FIGS. 7 and 8, a comparison of the measured antenna performance characteristics between the second conventional antenna 2 and the revised antenna 3 is shown. It can be observed that the revised antenna 3 is able to generate a return loss and antenna efficiency that matches well to that of the second conventional antenna 2. Hence the gridded antenna 3 has a reduction conductive area while retaining its original performance characteristics.

It will be understood that the above-mentioned particular embodiments is shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. An antenna comprising:

a substrate;

an antenna layer disposed on a top surface of the substrate, including a patch and a feed line electrically connected to the patch, the patch including a plurality of slots disposed in the patch for forming a gridding part and an edge part surrounding the gridding part; all of the plurality of slots symmetrically disposed at a center of the patch; wherein the gridding part has a first side and a second side perpendicular to the first side; the patch has a first edge parallel to the first side and a second edge parallel to the second side; the edge part has a first width defined from the first side to the first edge; the patch has a third width defined by a length of the second edge; wherein, a radio between the first width and the third width is at least 0.32.

2. The antenna as claimed in claim 1, wherein the antenna layer is printed on the substrate with conductive ink.

3. The antenna as claimed in claim 2, wherein the substrate is made of FR-4 substrate.

4. The antenna as claimed in claim 1, wherein the patch is square or rectangular.

5. The antenna as claimed in claim 1, wherein the number of the slots is arranged in matrixes ranging from 3 by 3 to 20 by 20.

6. An antenna comprising:

a metallic sheet including a plurality of slots disposed in the metallic sheet for forming a gridding part and an edge part surrounding the gridding part; all of the plurality of slots symmetrically disposed at a center of the metallic sheet; wherein the gridding part has a first side and a second side perpendicular to the first side; the metallic sheet has a first edge parallel to the first side and a second edge parallel to the second side; the edge part has a first width defined from the first side to the first edge; the metallic sheet has a third width defined by a length of the second edge; wherein, a radio between the first width and the third width is at least 0.32.

7. The antenna as claimed in claim 6, wherein the antenna is a Planar Inverted-F Antenna working at GSM-850 and PCS-1900 bands.

8. The antenna as claimed in claim 6, wherein at least 30% of a conductive area of the antenna layer is reduced by the slots.

9. A method for manufacturing an antenna, comprising the steps of:

forming an antenna layer, the antenna layer including a plurality of slots disposed in the antenna layer forming a gridding part and an edge part surrounding the gridding part, all of the plurality of slots symmetrically disposed at a center of the antenna layer; wherein the gridding part has a first side and a second side perpendicular to the first side; the antenna layer has a first edge parallel to the first side and a second edge parallel to the second side; the edge part has a first width defined from the first side to the first edge; the antenna layer has a third width defined by a length of the second edge; wherein, a radio between the first width and the third width is at least 0.32.

10. The method for manufacturing an antenna as claimed in claim 9, wherein a substrate is provided, and the antenna layer is printed on the substrate with conductive ink.

11. The method for manufacturing an antenna as claimed in claim 10, wherein the antenna layer is made by cutting a copper sheet.

12. The antenna as claimed in claim 1, wherein the edge part has a second width defined from the second side to the second edge; the patch has a fourth width defined by a length of the first edge; wherein, a radio between the second width and the fourth width is at least 0.32.

* * * * *